US010648323B2

(12) United States Patent
Hughes et al.

(10) Patent No.: US 10,648,323 B2
(45) Date of Patent: May 12, 2020

(54) APPARATUS AND METHOD FOR LOCATING AND SETTING A TOOL IN A PROFILE

(71) Applicant: The WellBoss Company, Inc., Calgary (CA)

(72) Inventors: John Hughes, Calgary (CA); James W. Schmidt, Calgary (CA); Donald Joseph Radmanovich, High River (CA)

(73) Assignee: The WellBoss Company, Inc. (CA)

( * ) Notice: Subject to any disclaimer, the term of this patent is extended or adjusted under 35 U.S.C. 154(b) by 112 days.

(21) Appl. No.: 15/621,288

(22) Filed: Jun. 13, 2017

(65) Prior Publication Data

US 2018/0038221 A1 Feb. 8, 2018

Related U.S. Application Data

(60) Provisional application No. 62/350,069, filed on Jun. 14, 2016.

(51) Int. Cl.

| | |
|---|---|
| ***E21B 47/09*** | (2012.01) |
| ***E21B 23/02*** | (2006.01) |
| ***E21B 23/06*** | (2006.01) |
| ***E21B 33/129*** | (2006.01) |
| ***E21B 23/00*** | (2006.01) |
| ***E21B 23/14*** | (2006.01) |
| ***E21B 33/124*** | (2006.01) |
| ***E21B 34/06*** | (2006.01) |

(52) U.S. Cl.

CPC ..... *E21B 47/0915* (2013.01); *E21B 23/006* (2013.01); *E21B 23/02* (2013.01); *E21B 23/14* (2013.01); *E21B 33/124* (2013.01); *E21B 33/1291* (2013.01); *E21B 34/06* (2013.01); *E21B 47/09* (2013.01)

(58) Field of Classification Search

CPC ..... E21B 47/09; E21B 33/124; E21B 23/02; E21B 23/06

See application file for complete search history.

(56) References Cited

U.S. PATENT DOCUMENTS

| | | | |
|---|---|---|---|
| 9,097,079 | B2 | 8/2015 | Themig |
| 2016/0298404 | A1 | 10/2016 | Beckett et al. |

*Primary Examiner* — Catherine Loikith

(74) *Attorney, Agent, or Firm* — Rao DeBoer Osterrieder, PLLC; John M. DeBoer

(57) ABSTRACT

A device is provided for positively locating within a profile, wherein the device includes one or more radially resilient locator mechanisms; one or more slips; one or more packing elements; and a stopping mechanism; wherein the one or more locator mechanisms are radially expandable to locate within the profile and wherein the stopping mechanism prevents engagement of the one or more slips and the one or more packing elements unit the one or more locator mechanisms are located in the profile. A method is also provided for applying downhole isolation.

13 Claims, 11 Drawing Sheets

FIGURE 2a
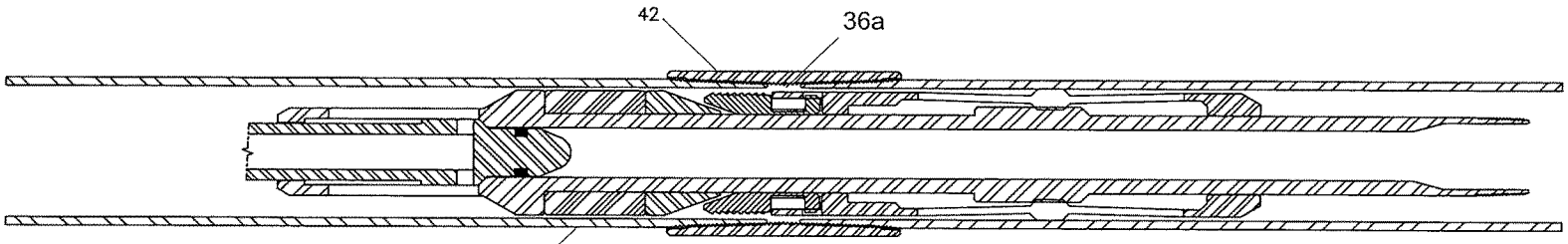
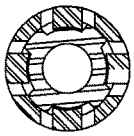
Figure 2b

FIGURE 3A
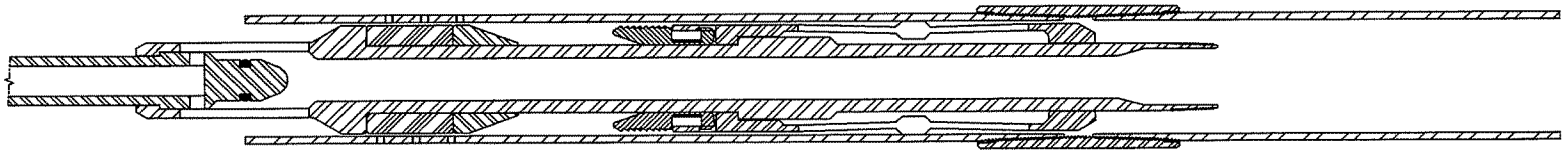
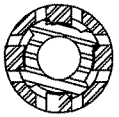
Figure 3B

FIGURE 4A
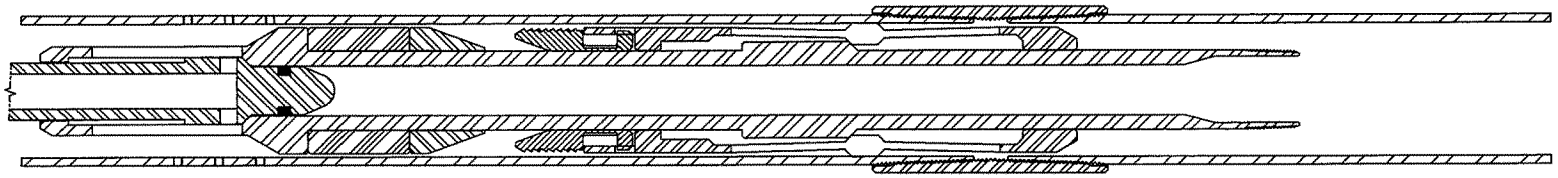
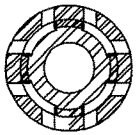
Figure 4B

FIGURE 5A
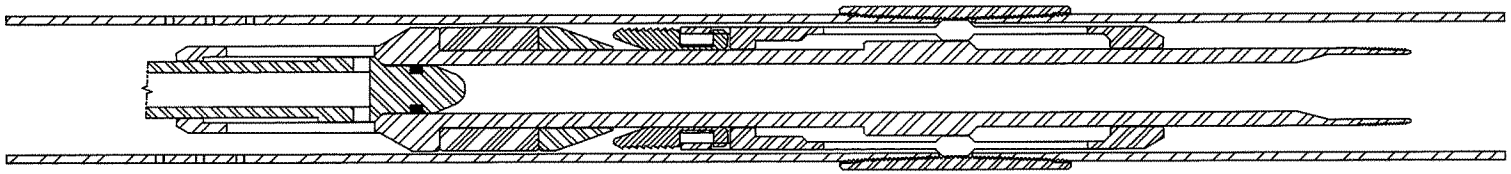
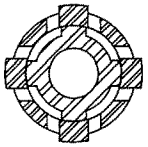
Figure 5B

APPARATUS AND METHOD FOR LOCATING AND SETTING A TOOL IN A PROFILE

FIELD OF THE INVENTION

The present invention relates to an apparatus and method for locating and setting a tool such as a bottom hole assembly or intervention tool within a downhole tool and within a blank pipe.

BACKGROUND OF THE INVENTION

Downhole oil and gas production operations, and particularly those in multi-stage horizontal wells, require the stimulation and production of one or more zones of a hydrocarbon bearing formation. In many cases this is done by running a liner or casing string downhole, in which the casing string comprises one or more downhole tools, including but not limited to perforating devices, ported sleeves or collars, at spaced intervals along the wellbore. The location of the downhole tools is commonly set to align with the formation zones to be stimulated or produced. The tools must be manipulated in order to be opened or closed as required. In some instances, this is achieved by running a bottom hole assembly, also known as an intervention tool, down through the casing string, locating the downhole tool to be manipulated and manipulating the tool by any number of means including use of mechanical force on the intervention tool, or by hydraulic pressure.

The bottom hole assembly (BHA), or intervention tool, also known by any number of other names, is typically run on a tubing string that can be coil tubing or other tubing. The intervention tool is sent down inside the casing string for the purposes of locating inside and interacting with the downhole tool adjacent the formation zone to be treated or produced. Once located near or inside the downhole tool, the intervention tool typically engages against the downhole tool or against the casing near the downhole tool, and then the intervention tool is either mechanically manipulated or hydraulic pressure is used to manipulate the downhole tool as required to stimulate the oil-bearing formation, or to produce hydrocarbons from the formation. After treatment, it may also be desirable to again manipulate the downhole tool. In many cases, it is also desirable to locate and set an intervention tool in a casing string or a section of blank pipe.

A key goal in using an intervention tool is to accurately locate the intervention tool inside the downhole tool or inside section of casing or blank pipe before going through the process of setting the intervention tool and trying to manipulate any downhole tools. Since there can be miles and miles of casing string with any number of downhole tools and lengths of blank pipe along it, this can be difficult.

Furthermore, due to reaction time commonly seen in coil tubing deployment, there is a tendency for the tubing on which the intervention tool is run downhole to travel downhole even after it has been located in the desired downhole tool. This extra travel causes the intervention tool to 'jump' out of its proper location in the downhole tool.

In some prior art, intervention tools use drag blocks and locator blocks to locate the intervention tool in the downhole tool. However, in many of these cases, extra length is required to account for coil tubing travel, leading to larger, less flexible sleeves and downhole tools. These have also been proven less successful in operation. Also, this type of prior art system does not ensure that any slips and packers on the intervention tool won't set before the locator blocks are located.

Other locating means that have been used in the past include locating dogs, latching mechanisms or by estimating the location of the downhole tool in the wellbore and feeding a predetermined length of deployment string to reach the frac sleeve.

There is therefore still a need for intervention tool and downhole tool systems that can positively locate an intervention tool inside a downhole tool or inside casing string, and for systems that ensures that slips and packing elements cannot be set before locating.

SUMMARY

An intervention tool is provided having one or more packing elements; said device being moveable between a first position in which the device is positively locatable within a profile, and a second position wherein the device is settable in a blank casing that lacks a profile, wherein movement between the first position and the second position is controlled by axial movement of the intervention tool.

A device is further provided for positively locating within a profile, wherein said device comprises one or more locator mechanisms; one or more slips; one or more packing elements; and a stopping mechanism; wherein said one or more locator mechanisms are locatable within said profile and wherein said stopping mechanism prevents engagement of said one or more slips and said one or more packing elements unit said one or more locator mechanisms are located in the profile.

A method is provided for applying downhole isolation, said method comprising the steps of running an intervention tool downhole, said intervention tool comprising one or more packing elements; locating one or more locating mechanisms on the device into one or more profiles by shifting said device axially; engaging the one or more packing elements by shifting said device axially after the locating mechanisms are located within the profiles; disengaging said one or more packing elements by shifting said device axially; and moving said device to another downhole location.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings:

FIG. 2A is a cross sectional elevational view of one embodiment of an intervention tool of the present invention, in a compressed but neutral position within a blank section casing string;

FIG. 2B is a cross sectional end view of one embodiment of the locator support relative to the locator mechanism in the position of FIG. 2A;

FIG. 3A is a cross sectional elevational view of one embodiment of an intervention tool of the present invention, in a tension position;

FIG. 3B is a cross sectional end view of one embodiment of the locator support relative to the locator mechanism in the position of FIG. 3A;

FIG. 4A is a cross sectional elevational view of one embodiment of an intervention tool of the present invention in compression prior to being located in a profile;

FIG. 4B is a cross sectional end view of one embodiment of the locator support relative to the locator mechanism in the position of FIG. 4A;

FIG. 5A is a cross sectional elevational view of one embodiment of an intervention tool of the present invention in compression and located within a profile, but just prior to slips and packer being set;

FIG. 5B is a cross sectional end view of one embodiment of the locator support relative to the locator mechanism in the position of FIG. 5A;

Figure 1:
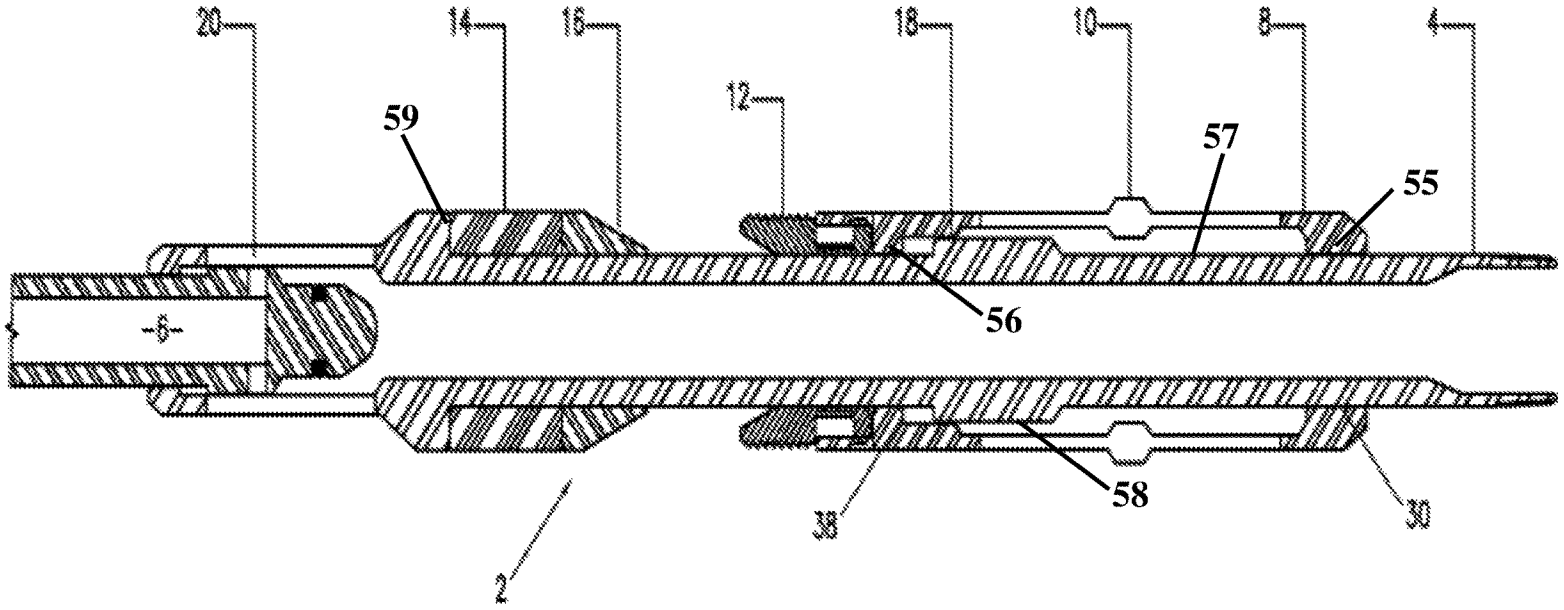
FIG. 1 is a cross sectional view of one embodiment of an intervention tool of the present invention.

The drawing is not necessarily to scale and in some instances proportions may have been exaggerated in order more clearly to depict certain features.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The present invention provides a device for positively locating an intervention tool in a profile. The profile can be on a downhole tool or on a casing. The present intervention tool is also capable of setting in a blank section of casing or pipe.

The present invention more specifically provides a locator mechanism and locator support arrangement that positively locates the intervention tool within a profile. The locator support ensures that the locator mechanism cannot dislocate once located. Furthermore, the locator mechanism and locator support arrangement vis a vis slips and packing element of the intervention tool prevents the slips and packing element from setting until the intervention tool is positively located in the profile. This not only ensures a positive locate, but also ensure no setting until there is a positive locate.

Although some embodiments of the present intervention tool are described and illustrated in the context of use with a ported sleeve, it would be well understood by a person of skill in the art that the present intervention tool could be used with any number of types of downhole tools that require locating and activation of some kind, including tools used in straddle perforation applications, any downhole tool in which a packer is required to set to create a pressure differential, or any downhole tool in which manipulation of the tool requires that a profile on the tool be engaged and mechanically manipulated. And the present tool can be shifted from locating in a downhole tool or casing having a profile, to setting inside a section of blank casing, wherein said shifting is accomplished merely be axial movement of the present tool.

With reference to FIG. 1, which illustrates one embodiment of an intervention tool 2 of the present invention, the intervention tool 2 comprises an inner mandrel section 4 having an outer surface 57 and a continuous axial inner bore 6. The mandrel 4 is preferably at least partially radially surrounded by a drag assembly 8 that is slidably arranged over an outer surface 57 of the mandrel 4. The drag assembly 8 houses a locator mechanism 10 and a set of one or more slips 12. The drag assembly 8 may include a first radial inner end 55 and a second radial inner end 56. The ends 55, 56 may be engaged with the outer mandrel surface 57. The locator mechanism 10 may be disposed between the first radial end 55 and the second radial end 56. In a preferred embodiment, the mandrel 4 is both axially and rotatably moveable vis a vis the drag assembly 8. In a more preferred embodiment, the locator mechanism 10 can be a set of one or more resilient collet fingers, however, it would be understood that locator blocks or dogs with springs would be just as suitable and are including in the scope of the present invention.

Figure 12:
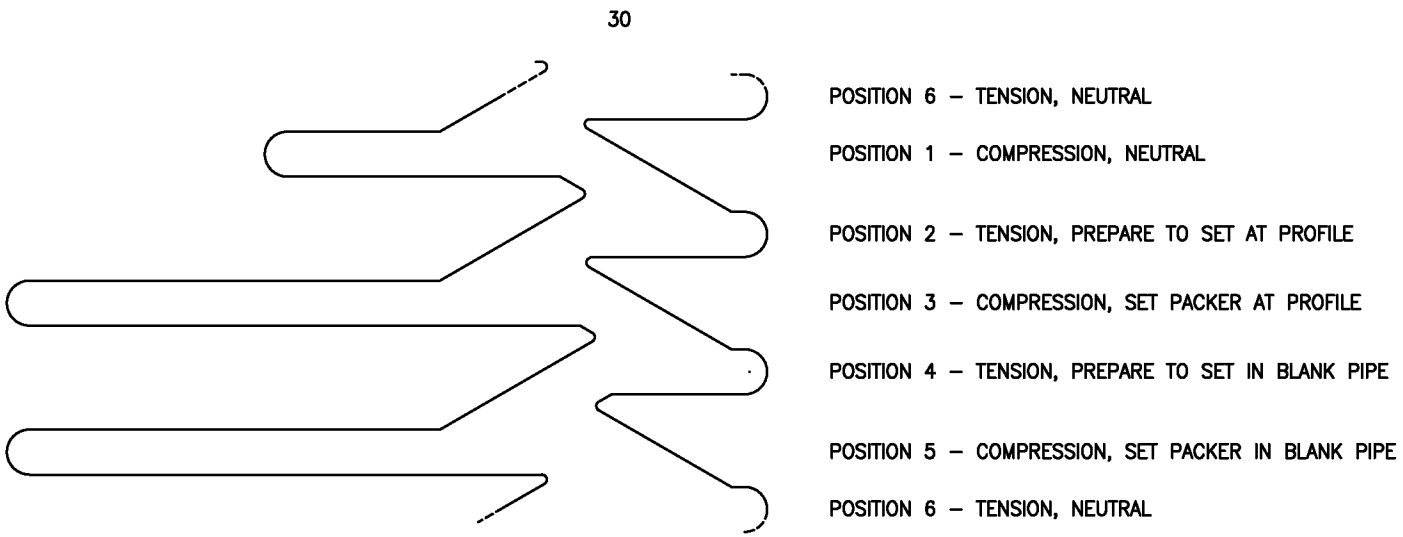
FIG. 12 illustrates J-pin and J-slot positions for the various steps of a method of the present invention.

With reference to FIG. 12, in a further preferred embodiment, a J-pin and J-slot arrangement 30 between the mandrel 4 and drag assembly 8 can guide movement of the mandrel 4 relative to the drag assembly 8 and ensures that the mandrel 4 position is held until a further compressive or tensile force is applied to move the mandrel 4 to the next position. By holding various positions between the mandrel 4 and the drag assembly 8, the J-pin and J-slot arrangement 30 ensures that the present intervention tool can be run downhole and located in a downhole tool without inadvertently setting slips 12 or packing elements 14 prior to locating. The arrangement 30 also allows shifting the intervention tool from locating in a profile to setting in a section of blank casing by only applying an axial tensile or compressive force.

The mandrel 4 houses on its outer surface 57 a packing element 14 and a slip setting cone 16. The packing element 14 may be disposed between an end shoulder 59 of the mandrel 4 and the slip setting cone 16. Preferably a locator support 18 is either integrally part of, or separate to but supported on, the outer surface of the mandrel 4. As shown in FIG. 1, the locator support 18 may have an outer planar surface 58. In a preferred embodiment, the locator support 18 is in the form of a collet support lug ring having one or more collet support lugs, however it would be understood by a person of skill in the art that any number of support devices and configurations to support the locator mechanism are possible and are included within the scope of this invention.

A bypass 20 is preferably moveably located within the inner bore 6 of the mandrel 4 and is moveable between a closed position which blocks fluid flow through the inner bore 6 to an open position which allows flow through the inner bore 6. The locator support 18 together with the mandrel 4 is moveable and rotatable relative to the locator mechanism 10 on the drag assembly 8, such that the locator support 18 may be able to pass under and beyond the locator mechanism 10 when the locator mechanism is in a collapsed position, sit directly under the locator mechanism 10 to support it in an extended position or abut an uphole or downhole end of the locator mechanism 10.

Figure 10:
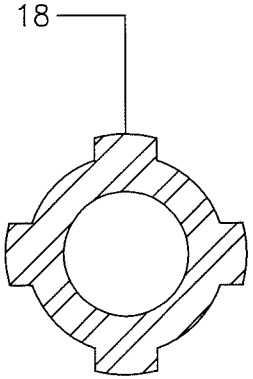
FIG. 10 is a cross sectional end view of one embodiment of the locator support of the present invention.

The locator support 18, seen in FIG. 10 preferably has a full bore inside diameter that allows for full fluid flow through inner bore when the bypass 20 is in the open position. The full bore of the locator support 18 ensure that the inner bore 6 of the present intervention tool does not get clogged up with sand from the formation, and ensures no flow restrictions.

Figures 7A, 7B:
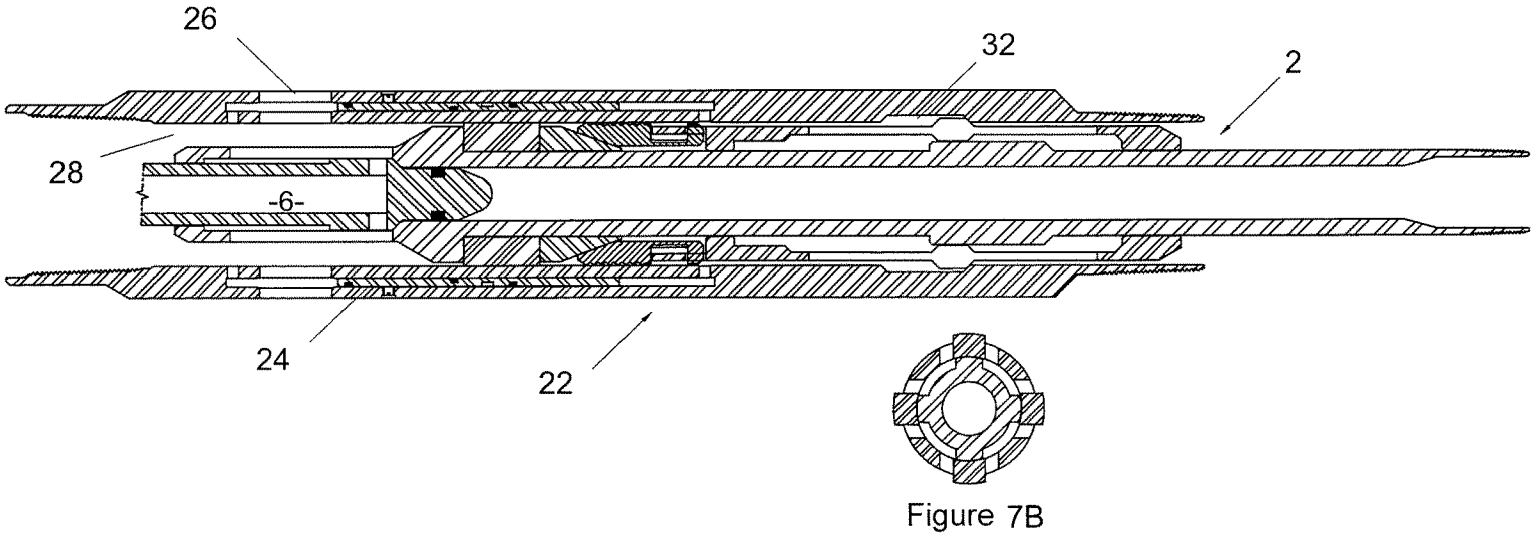
FIG. 7A is a cross sectional elevational view of one embodiment of an intervention tool of the present invention in compression and located within a profile of a downhole tool, with the slips and packing elements set.
FIG. 7B is a cross sectional end view of one embodiment of the locator support relative to the locator mechanism in the position of FIG. 7A.

With reference to FIGS. 7*a* and 7*b*, the intervention tool 2 of the present invention can be used inside a downhole tool 22. The downhole tool of FIG. 7*a* is depicted as a ported sleeve, however it would be understood that any number of downhole tools 22 can be located and manipulated by the present invention.

In the embodiment of FIG. 7*a*, the particular ported sleeve embodiment of the downhole tool 22 has a valve 24 that is moveable to close and open a port 26. When the valve 24 in in the open position, the port 26 is open and fluid can flow from either the inner bore 6 of the mandrel 4 or from an annulus 28 between the mandrel 4 an inner surface of the downhole tool 22 through the port 26 and out to the formation to be treated or stimulated. While the present figures depicts the valve 24 of the downhole tool 22 as being an inner valve sandwiched between an outer and inner layer of the downhole tool 22, it would be well understood by a person of skill in the art that an exposed valve would be just as effective and is covered in the scope of the present application.

It would also be understood by a person of skill in the art that the downhole tool 22 can be a production sleeve in which case, hydrocarbon product can flow from the formation, through the port 26 and back up to surface through the tubing on which the intervention tool 2 is run, or through the casing 36 on which the downhole tool 22 is run. Such embodiments are also covered by the scope of the present invention.

The downhole tool 22 further comprises a profile 32 on an inner surface thereof, for receiving the locator mechanism 10, which can expand radially into profile 32, to positively locate the intervention tool 2 inside the downhole tool 22, prior to setting any slips 12 or packing elements 14.

With reference to FIGS. 2*a* and 2*b* in one embodiment of a method of the present invention, the intervention tool 2 is run into the wellbore casing 36 in a compressed, but neutral position. In this position, cone 16 cannot contact the slips 12 and packing element 14 cannot be set. The intervention tool 2 is run down to the downhole tool 22 in this position. The locator mechanism 10 of the drag assembly 8, which are preferably radially resilient, are collapsed and preferably act as a drag mechanism to allow the mandrel 4 to move relative the drag assembly 8 for subsequent operations and positions. While the locator mechanism may extend to locate in a profile 36*a* of the casing 36, as depicted in FIG. 2*b*, the locator support 18 is positioned such that it does not support the locator mechanism 10 in the extended position, and thus further downhole movement of the intervention tool 2 will cause the locator mechanism 10 to collapse again and allow the device to continue to travel downhole to a desired location. For the purposes of the present invention, a casing connection 42 can serve as a locating profile 36*a* for locating the intervention tool 2 in the casing section 36. In a preferred embodiment, the locator mechanism 10 may be machined to an exact shape to fit into a specific profile 36*a* of a casing connection 42 or a profile 32 of a downhole tool 22 (depicted in FIG. 7*a*).

As the intervention tool 2 is moved downhole, the mandrel 4 will move downhole relative to the drag assembly 8 until it hits a stopping mechanism in the form of the J-pin and J-slot arrangement 30 between the mandrel 4 and drag assembly 8. The mandrel 4 is unable to travel down far enough to contact the cone 16; therefore, the packing element 14 cannot set while running downhole.

With reference to FIGS. 3*a* and 3*b*, in a next step the intervention tool 2 is pulled into tension and the mandrel 4 and locator support 18 rotate relative to the drag assembly 8. This movement and rotation is guided by the J-pin and J-slot arrangement 30. Again, the collapsed locator mechanism 10 of the drag assembly 8 act as the drag mechanism to allow the mandrel 4 to move relative the drag assembly 8 for subsequent operations and the J-pin and J-slot arrangement 30 ensure that the position is held until a compression or tension is applied to the intervention tool 2.

In a next step of the method, illustrated by FIGS. 4*a* and 4*b* the intervention tool 2 is pushed into compression and the mandrel 4 and locator support 18 rotate to align with the collapsed locator mechanism 10 of the drag assembly. In this position, the locator support 18 is located axially uphole of the locator mechanism 10, with an end of the locator support 18 aligned with and abutting against an end of the collapsed locator mechanism 10. In this orientation, contact of the abutting ends allows the drag assembly 8 to be pushed downhole together with the mandrel 4, without the cone 16 contacting the slips 12. Compression through the mandrel 4 pushes the drag assembly 8 downhole while the locator mechanism 10 is collapsed. Due to the position of the J-pin and J-slot arrangement, the mandrel 4 is unable to travel down far enough to contact the cone 16; therefore, the packing element 14 cannot set while running downhole as long as the locator mechanism 10 remains collapsed.

In a next step, illustrated in FIGS. 5*a* and 5*b* the intervention tool 2 moves freely downhole through the casing 36 until the collapsed locator mechanism 10 aligns with the matching profile 36*a* in the casing connection 42. When the locator mechanism 10 is at the matching profile 36*a* it extends radially outwards. Extension of the locator mechanism 10 allows the mandrel 4 to move further downhole relative the drag assembly 8 and for the locator support 18 to become positioned under the extended locator mechanism 10. In this way, the locator support 18 prevents the locator mechanism 10 from collapsing as further compression is applied to the intervention tool 2, and prevent the drag assembly 8 from travelling further downhole.

Figure 6A:
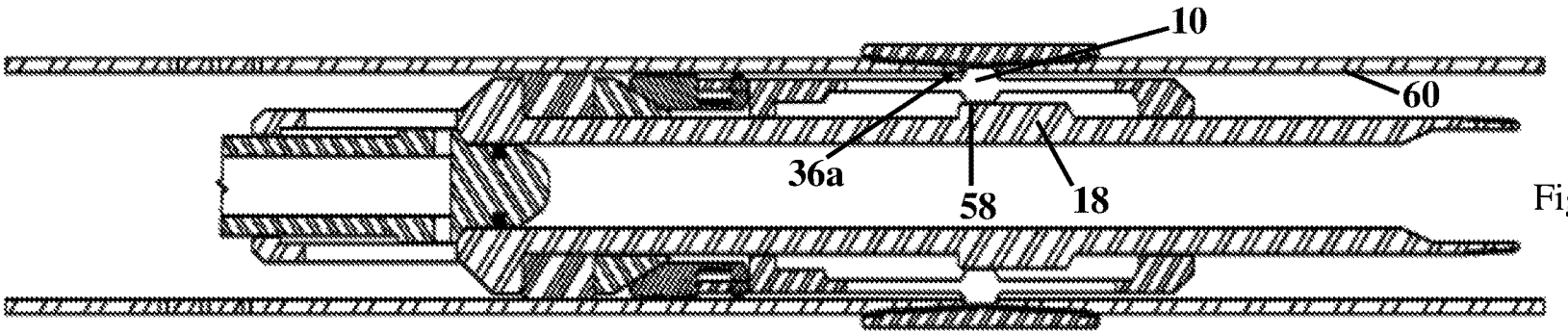
FIG. 6A is a cross sectional elevational view of one embodiment of an intervention tool of the present invention in compression and located within a profile, with the slips and packing elements set.
Figure 6B:
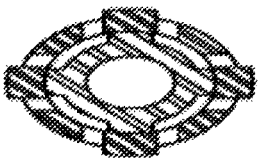
FIG. 6B is a cross sectional end view of one embodiment of the locator support relative to the locator mechanism in the position of FIG. 6A.

As illustrated in FIGS. 6*a* and 6*b*, continued compression of the intervention tool 2 moves the cone 16 into contact with the slips 12 and the slips 12 are urged radially outward to contact an inner surface 60 of the casing 36. The packing element 14 is also set. The locator mechanism 10, now positioned in profile 36*a*, no longer moves downhole and the mandrel 4 and the locator support 18 move downhole in compression such that the they travel under and along the locator mechanism 10. As shown here, in the set position of the tool 2, the outer planar surface 58 of the support 18 may be engaged with the locator mechanism 10.

Once located in the profile 36*a* and with the locator support 18 positioned underneath, the locator mechanism 10 further serves to lock the intervention tool 2 into place and prevent it from jumping out of position due to any downhole travel that can occur with coil tubing or other piping reaction time from being deployed downhole. The locator mechanism 10 supported by the locator support 18 serves to absorb any such downhole travel energy and ensures that once located, the intervention tool 2 stays located.

With reference to FIGS. 7*a* and 7*b*, although the description above makes reference to a profile 36*a* within a casing 36, and more preferably in a casing connection 42, it would be readily understood that the present intervention tool 2 is also locatable in downhole tool 22, including but not limited to ported collars, sleeve tools, straddle perforating equipment and others. In such cases, the intervention tool is deployed in much the same way as described above and can be located, as illustrated in FIG. 7*a*, in a profile 32 of the downhole tool 22. The profile 32 take the form of any feature within the downhole tool that can receive the radially extended locator mechanism 10, or the profile 32 may be machined specifically to fit the locator mechanism 10.

The locator mechanism 10 of the drag assembly 8 acts to generate drag between the drag assembly 8 and inner surface of the wellbore casing 36 or downhole tool 22 when collapsed. This allows the mandrel 4 to rotatably and axially move relative to the drag assembly 8, preferably with the J-pin and J-slot arrangement 30 guiding this movement. The locator mechanism 10 further serves to prevent the slips 12 and packing elements 14 from setting prior to the locator mechanism 10 expanding into the matching profile 32 in the downhole tool 22, since the J-pin and J-slot arrangement 30 and the locator support 18 prevent sufficient movement of the mandrel 4 vis a vis the drag assembly 8 until the locator support 18 can be positioned under the locator mechanism 10.

This arrangement ensures that the intervention tool 2 is positively located in the profile 32, so that the slips 12 and packing element 14 are set at the correct location in the downhole tool 22.

As illustrated in FIG. 7*a*, once the intervention tool 2 is located and the slips 12 and packing element 14 set, hydraulic pressure can be applied either down the inner bore 6 of the intervention tool 2, or through the annulus 28 between the mandrel 4 an inner surface of the downhole tool 22 to create pressure differential between an uphole end of the valve 24 and a downhole end of the valve 24, the uphole end being isolated from the downhole end by the packing element 14. This pressure differential causes the valve 24 to shift from a closed position to an open position and allows fluid to pass through the port 26 and out to the formation to be treated or stimulated, or alternatively, allows production fluids to travel in from the formation through the port 26 and up to surface.

In the case of an exposed valve 24, it is also possible to open the valve 24 by physically engaging the valve 24 and the use of mechanical force to move the valve 24 from a port-closed to a port-opened position. In such cases the intervention tool 2 can incorporate a mechanical shifting mechanism (not shown) to engage the profile 32 and mechanically manipulate the downhole tool 22.

To remove the intervention tool 2 from inside the downhole tool 22 or the casing 36, the intervention tool 2 can be pulled into tension to release the packed off packing element 14 and pull the cone 16 away from the slips 12, thereby releasing engagement of the packing element 14 and slips 12 from the inner surface of either the downhole tool 22 or the casing 36. Design of the J-pin and J-slot arrangement 30 causes the mandrel 4 and locator support 18 to rotate relative to the drag assembly 8, to allow the intervention tool 2 to be pulled into a section of blank casing 36.

There are a number of steps and positions in the running in, locating and setting of the intervention tool 2, and each position of the intervention tool 2 during operation is preferably set or guided by the J-pin and J-slot arrangement 30, that ensure that the intervention tool 2 stays in the desired position until a compression or tension forces it to move to the next J-pin/J-slot position.

In some cases, it is desirable to set the present intervention tool in a section of casing 36 either uphole or downhole from the downhole tool 22. Such arrangement is desirable when pressure testing the casing string and/or the downhole tool above the other downhole tools that have already been opened, it is also useful when it is necessary to sand jet perforate between downhole tools.

In setting the present intervention tool 2 inside a blank section of casing 36, the collapsed locator mechanism 10 of the drag assembly 8 again act as a drag mechanism between the intervention tool 2 and the inner surface of the blank section of casing 36, to allow relative movement of these two components for subsequent operations.

Figure 8A:
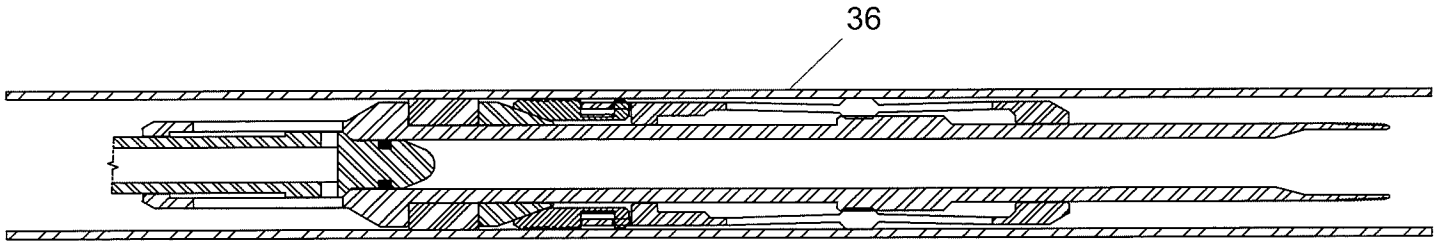
FIG. 8A is a cross sectional elevational view of one embodiment of an intervention tool of the present invention, within a blank section casing string, in a compressed position with the slips and packing elements set against an inner surface of the blank casing section.
Figure 8B:
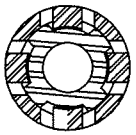
FIG. 8B is a cross sectional end view of one embodiment of the locator support relative to the locator mechanism in the position of FIG. 8A.

Once the intervention tool has been pulled uphole into the blank section of casing 36, with reference to FIGS. 8*a* and 8*b* the intervention tool 2 is pushed into compression. The mandrel 4 and locator support 18 rotate relative to the drag assembly 8 so that the locator support 18 is aligned such that it can travel under and through the collapsed locator mechanism 10. In the particular case illustrated in FIG. 8*a*, the locator support 18 comprises lugs and a preferred embodiment of the locator mechanism 10 comprises spaced apart fingers; the locator support lugs can align with the spaces between the locator mechanism fingers and can therefore travel through them. Further compression of the intervention tool 2 moves the cone 16 into contact with the slips 12 and the slips 12 are urged radially outwards to contact the inner surface of the section of blank casing 36. The slips 12 now support compressive loads as further compression packs off the packing element 14, as illustrated in FIG. 8*b*.

To release the intervention tool 2, it is pulled into tension to release the compression from the packed off packing element 14 and to pull the cone 16 out from under the slips 12. The mandrel 4 and locator support 18 rotate and move axially relative to the locator mechanism 10 of the drag assembly 8 to position the locator support 18 out from under the locator mechanism 10 and uphole of the locator mechanism 10. The packer 14 is unset and the intervention tool 2 can be moved uphole. The collapsed locator mechanism 10 of the drag assembly 8 act as the drag mechanism for subsequent operations.

Figure 11A:
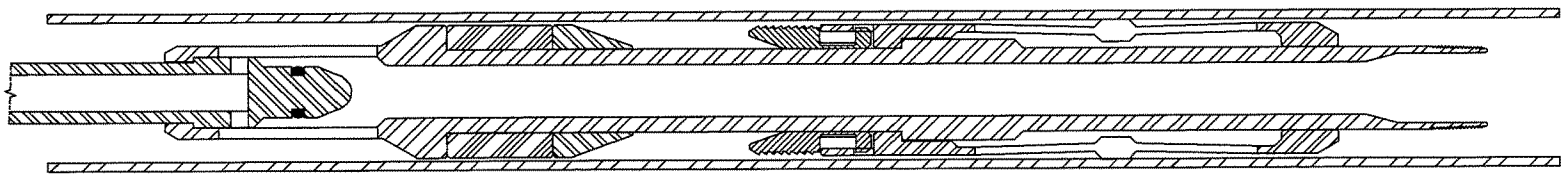
FIG. 11A is a cross sectional elevational view of one embodiment of the intervention tool of the present invention, within a blank section of casing string, in a tension neutral position.

In a final step, with reference to FIG. 11*a*, the intervention tool 2 can be pulled to bring the J-pin and J-slot arrangement 30 back to a position similar to the initial tension, neutral position of the intervention tool 2, and any of the steps above can be repeated as needed. In a preferred embodiment, the mandrel 4 is prevented from being pulled entirely out of the drag assembly 8 by means of a stop 38 formed on an inner surface of the drag assembly 8, which catches an end of the locator support 18.

Figure 9B:
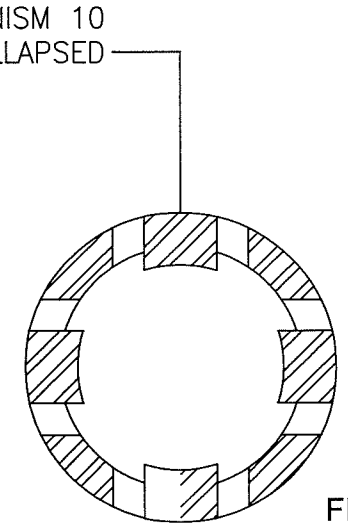
FIGS. 9A and 9B are cross sectional end views of one embodiment of the locator mechanism of the present invention in extended and collapsed views respectively.
Figure 9A:
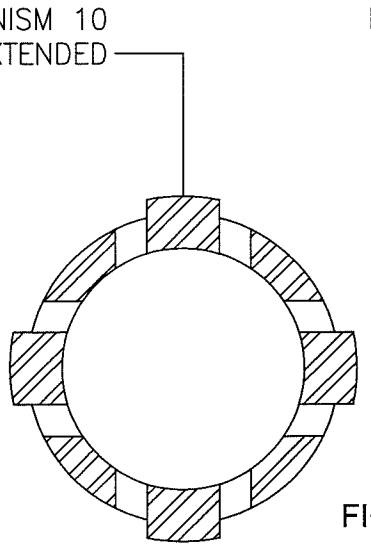
Figure 11C:
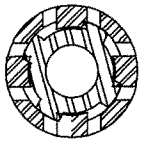
FIGS. 11B to 11C are cross sectional end views of various positions of one embodiment of the locator support relative to the locator mechanism.
Figure 11B:
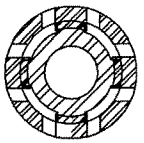

Referring now to FIGS. 9*a* and 9*b* together, cross-sectional views of a locator mechanism of an intervention tool in a varied position, in accordance with the disclosure, are shown. FIG. 9*a* shows a cross section of the locator mechanism 10 of the drag assembly in a collapsed position, while FIG. 9*b* shows a cross section of the locator mechanism 10 in an extended position. FIG. 10 represents a cross section the collet support lugs, showing the full bore opening 40. FIGS. 11*b* to 11*c* represent a number of position of the locator support 18 relative to the locator mechanism 10.

With further reference to FIG. 12, there are preferably 6 positions of the J-pin and J-slot arrangement 30 used to control each position of the present intervention tool 2:

1. Compression neutral.
2. Tension to prepare to set at a profile.
3. Compression to set slips and pack-off the element.
4. Tension to prepare to set in blank pipe.
5. Compression to set slips and pack-off the element in blank pipe.
6. Tension neutral.

In the present arrangement, the room for tubing travel is provided by two movements: movement of the locator mechanism 10 into the matching profile 32; and movement of the locator support 18 under the locator mechanism 10 to hold the locator mechanism 10 in the extended position. This way there is always a positive locate without the intervention tool 2 'jumping' forward or out of alignment The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A method for applying downhole isolation, said method comprising the steps of:

a. running an intervention tool downhole to a first downhole location, the intervention tool comprising:
  an inner mandrel, the inner mandrel further comprising:
    an outer mandrel surface;
    a locator support integral with the outer mandrel surface, the locator support configured with an outer planar surface; and
    an end shoulder,
  a drag assembly slidably movable around the inner mandrel, the drag assembly further comprising:
    a first radial inner end slidably engaged with the outer mandrel surface;
    a second radial inner end slidably engaged with the outer mandrel surface;
    an at least one locator mechanism disposed between the first radial inner end and the second radial inner end;
  a slip disposed around the inner mandrel;
  a cone disposed around the inner mandrel; and
  a packing element disposed around the inner mandrel, and also disposed between the end shoulder and the cone b. locating the at least one locator mechanism into an external profile by shifting the intervention tool axially;

c. engaging the packing element with a surrounding surface by shifting the intervention tool axially, while the at least one locator mechanism is located within the external profile;

d. disengaging the packing element by shifting the intervention tool axially; and e. moving the intervention tool to another downhole location.

2. The method of claim 1, further comprising: a. moving said intervention tool to a section of blank casing lacking a profile; and b. setting said one or more packing elements in the blank casing by shifting said intervention tool axially.

3. An intervention tool for positively locating within a profile, the intervention tool comprising:

an inner mandrel, the inner mandrel further comprising:
  an outer mandrel surface;
  a locator support integral with the outer mandrel surface, the locator support configured with an outer planar surface; and
  an end shoulder,
a drag assembly slidably movable around the inner mandrel, the drag assembly further comprising:
  a first radial inner end slidably engaged with the outer mandrel surface;
  a second radial inner end slidably engaged with the outer mandrel surface;
  an at least one locator mechanism disposed between the first radial inner end and the second radial inner end;
a slip disposed around the inner mandrel;
a cone disposed around the inner mandrel;
a packing element disposed around the inner mandrel, and also disposed between the end shoulder and the cone, wherein the intervention tool comprises an unset and set position, wherein the set position comprises the at least one locator mechanism is located in the profile, and the outer planar surface engaged with the at least one locator mechanism.

4. The intervention tool of claim 3, wherein the second radial end is configured with a a stopping mechanism;

wherein the at least one locator mechanism is radially expandable to locate within the profile and wherein the stopping mechanism prevents engagement of the slip or packing element until the at least one locator mechanisms is located in the profile.

5. The intervention tool of claim 4 wherein the inner mandrel is axially and rotatably moveable with respect to the drag assembly and wherein the stopping mechanism is arranged between said drag assembly and said mandrel.

6. The intervention tool of claim 3, wherein the profile is associated with one of a casing and a downhole tool, wherein the drag assembly is configured to generate drag between a respective inner surface of either the casing or the downhole tool and the drag assembly to thereby allow the inner mandrel to move axially and radially relative the drag assembly.

7. An intervention tool for positively locating within a profile, the intervention tool comprising:

an inner mandrel, the inner mandrel further comprising:

an outer mandrel surface;

a locator support integral with, and protruding outward from, the outer mandrel surface, the locator support configured with an outer planar surface; and an end shoulder, a drag assembly movable around the inner mandrel, the drag assembly further comprising:

a first radial inner end movably engaged with the outer mandrel surface;

a second radial inner end movably engaged with the outer mandrel surface;

an at least one locator mechanism disposed between the first radial inner end and the second radial inner end;

a slip disposed around the inner mandrel;

a cone disposed around the inner mandrel;

a packing element disposed around the inner mandrel, and also disposed between, and engaged with, each of the end shoulder and the cone, wherein the intervention tool comprises an unset and set position, wherein the set position comprises the at least one locator mechanism located in the profile, and the outer planar surface engaged with an underside of the at least one locator mechanism.

8. The intervention tool of claim 7, wherein the second radial end is configured with a a stopping mechanism.

9. The intervention tool of claim 8, wherein the at least one locator mechanism is radially expandable to locate within the profile, and wherein the stopping mechanism prevents engagement of the slip or packing element until the at least one locator mechanisms is located in the profile.

10. The intervention tool of claim 9, wherein the inner mandrel is axially and rotatably moveable with respect to the drag assembly, and wherein the stopping mechanism is arranged between said drag assembly and said mandrel.

11. The intervention tool of claim 7, wherein the inner mandrel is axially and rotatably moveable with respect to the drag assembly, and wherein the stopping mechanism is arranged between said drag assembly and said mandrel.

12. The intervention tool of claim 11, wherein the profile is associated with one of a casing and a downhole tool, wherein the drag assembly is configured to generate drag between a respective inner surface of either the casing or the downhole tool and the drag assembly to thereby allow the inner mandrel to move axially and radially relative the drag assembly.

13. The intervention tool of claim 11, wherein the profile is associated with one of a casing and a downhole tool, wherein the drag assembly is configured to generate drag between a respective inner surface of either the casing or the downhole tool and the drag assembly to thereby allow the inner mandrel to move axially and radially relative the drag assembly.

* * * * *